United States Patent [19]

Kanno et al.

[11] 4,340,946

[45] Jul. 20, 1982

[54] ELECTRONIC TIMEPIECE

[75] Inventors: Fumio Kanno; Fumio Nakajima, both of Tokorozawa, Japan

[73] Assignee: Citizen Watch Company Limited, Tokyo, Japan

[21] Appl. No.: 171,914

[22] Filed: Jul. 24, 1980

[30] Foreign Application Priority Data

Jul. 27, 1979 [JP] Japan ..... 54-94933

[51] Int. Cl.[3] ..... G04B 19/00

[52] U.S. Cl. ..... 368/76; 368/157; 318/696

[58] Field of Search ..... 368/76, 80, 155–160, 368/203–204, 217–219, 85–87; 318/696

[56] References Cited

U.S. PATENT DOCUMENTS 4,272,837 6/1981 Deda et al. ..... 368/80

4,276,626 6/1981 Satoh et al. ..... 368/80

4,315,329 2/1982 Torisaua et al. ..... 368/76

*Primary Examiner*—Vit W. Miska

*Attorney, Agent, or Firm*—Jordan and Hamburg

[57] ABSTRACT

An electronic timepiece havig a stepping motor driving time indicating hands is provided with a system whereby the stepping motor is selectively driven at one of three different drive power levels, in accordance with the load currently being applied to the motor. Detection of the load level is performed by momentarily sampling a voltage induced in the motor drive coil during a short time interval following a drive pulse. The system provides rapid response to changes in load level, highly stable control, and excellent tolerance to variations in characteristics of different stepping motors and circuit components.

8 Claims, 17 Drawing Figures

STANDARD FREQUENCY OSCILLATOR
10
FREQUENCY DIVIDER
12
WAVEFORM CONVERTER 14
LOW DRIVE INPUT SIGNAL GENERATING CIRCUIT
INTERMEDIATE DRIVE INPUT SIGNAL GENERATING CIRCUIT
HIGH DRIVE INPUT SIGNAL GENERATING CIRCUIT
SAMPLING SIGNAL GENERATING CIRCUIT
SELECTOR CIRCUIT 51
DRIVE CIRCUIT 16
XA
XB
YA
YB
ZA
ZB
So
26
28
30
32
40
44
46
48
50
52
62
64
66
68
19
VDD
Vss

I
II
5.9ms
t6 ms
t3ms
t31ms
t32ms
t33ms
t1ms
t4ms
t41ms
t2ms
t5ms
t51ms
(a)
(b)
(c)
(d)
(e)
(f)
(g)
(h)
(i)
(j)
(k)
(ℓ)
(m)
(n)

ELECTRONIC TIMEPIECE

BACKGROUND OF THE INVENTION

At the present time, electronic timepieces which employ a stepping motor to drive time indicating means such as time indicating hands and a calendar display device, are in widespread use. In such a timepiece, the question of reducing battery power consumption as far as possible is extremely important, due to the fact that reduced consumption enables battery size, and hence timepiece size overall, to be reduced. This is of course advantageous in the case of an electronic wristwatch. However, in the case of a timepiece having an auxiliary indicating mechanism, such as a date display, it becomes difficult to arrange that the battery consumption will be held to a suitable minimum value, due to the fact that each time the date display mechanism is driven by the timepiece gear train, the load applied to the stepping motor increases significantly above its normal level. Thus, if the level of drive power applied to the stepping motor during each drive pulse is set to be sufficient for normal operation, this may be insufficient to consistently drive the timepiece under a heavy load condition. Similarly, if the level of drive power is set to be sufficient for operation under the heavy load state, this will result in excessive and wasteful power consumption during the normal, light load condition. In view of this, various schemes have been proposed for detecting the load currently being applied to the stepping motor, and for controlling the power of the drive pulses applied to the motor in accordance with the results of this detection, so that the drive power is reduced when a heavy load is applied and is increased when a light load is applied to the motor. However, accurate realization of such schemes in the case of mass-production timepieces has proved to be extremely difficult. While it may be possible to arrange for such a system to operate in a satisfactory way for a particular stepping motor and circuit, variations in the components of the stepping motors, and variations of the threshold voltage of circuit components such as inverters used for load detection purposes make it difficult or impossible to obtain satisfactory and uniform results on a mass production basis. In general, the case of detecting an increase in load and providing an increase in the drive power to meet this increase can be quite easily accomplished. However, the case of changing from high-power drive to low power drive, when the load on the stepping motor subsequently is reduced, causes serious problems, with a conventional drive power control system. Because of such difficulties, it has been proposed to provide timer means for controlling the duration of an increased drive power status. With this, as soon as a high load on the stepping motor is detected, the drive power is increased for a predetermined period, set by the timer means. When this time has elapsed, then a return to the low-power drive status is performed. Such a system has the disadvantage that power consumption is not minimized to the greatest possible degree, because of the fact that no attempt is made to detect a change from the high load to the low load condition. For example, when an increase from the light load to the heavy load condition is detected, then it is desirable that the drive power be immediately increased. In other words, if a low power drive pulse has been applied to the stepping motor, and if immediately thereafter it is detected that the motor is in the heavily loaded state, then it is usually necessary to apply a high power drive pulse to the motor immediately after that low-power drive pulse, in order to ensure that the motor will actually be stepped, with the heavy load applied to it. With a system employing a timer, then if the timer is set for too short a period of high-power drive, and if the motor continues to operate under the heavy load condition, the result will be that pairs of drive pulses, each consisting of a low power drive pulse followed by a high power drive pulse will be produced, after the time set by the timer has expired and while the heavy load is still being applied to the motor. This is obviously wasteful of power. On the other hand, if the time is set to be too long, then the motor will continue to be driven at the high power level for the entire duration of that time, even in the case of the high load condition being applied only momentarily. This again is a waste of battery power.

With a stepping motor drive control system according to the present invention, these disadvantages of prior art systems are effectively eliminated. This is done by arranging to selectively drive the stepping motor at one of at least three different power levels, in accordance with the load currently being applied to the motor. Immediately a change in the load is detected, a change is made to either the next lower or the next higher drive power level. Load level detection is accomplished by momentarily placing the drive coil of the stepping motor in an open circuit condition for a brief time interval immediately following a drive pulse, and detecting the level of a voltage induced in the coil at that time. It is an important feature of the present invention that the timing of these detection time intervals is varied in accordance with the current drive power status of the stepping motor, as is explained in detail with respect to the preferred embodiment. Use of a drive control system according to the present invention ensures that, each time a change in load level on the motor is detected, no more than a single excessive drive pulse will be produced (for example, a high power drive pulse immediately succeeding a low power drive pulse). Wasteful consumption of battery power is thereby considerably reduced by comparison with prior art systems for stepping motor drive power control in an electronic timepiece. In addition, a drive control system according to the present invention can operate successfuly in spite of wide variations in the characteristics of components in the stepping motor and in the detection circuitry.

SUMMARY OF THE INVENTION

The present invention is directed toward a system for controlling the drive power applied to a stepping motor of an electronic timepiece in accordance with the load applied to the stepping motor. The drive power can be selected to be at one of at least three different levels, and in the preferred embodiment described in the following specification these comprise a low power level, an intermediate power level and a high power level. Control of drive power level can be accomplished by control of the duration of each drive pulse, or can be performed as is done in the preferred embodiment by making the drive pulses for the high power drive consist of continuous pulses, making the intermediate power drive pulses consist of composite drive pulses comprising a burst of pulses of predetermined duty cycle, and making the low power drive pulses comprise composite drive pulses composed of pulse bursts of lower duty cycle than those of the intermediate drive pulses.

Detection of the level of load being applied to the stepping motor is performed by momentarily establishing a short-circuit condition across the the terminals of the stepping motor drive coil, during one or more time intervals which occur after each drive pulse has terminated, and by determining whether the level of voltage induced in the drive coil at that time is above or below a predetermined detection threshold level. Depending upon the results of this detection, the current drive power status may be continued, a change may be made to the next higher drive power level, or a change may be made to the next lower drive power level. It is an important feature of the present invention that when the system is operating in the intermediate drive power status (in the case of a system having three drive power levels), two successive drive coil voltage detection intervals are provided after each drive pulse. This enables the detection and control circuitry to decide whether to continue at the intermediate drive power level, or to change to the next higher or the next lower power level. It is another important feature of the present invention that the actual timing of each detection interval, in relation to the preceding drive pulse, is controlled in accordance with the current drive status, i.e. in accordance with whether the system is currently operating in the low power, intermediate power or high power drive condition. The importance of this feature will be made clear in the description of the preferred embodiment.

DESCRIPTION OF THE PREFERRED EMBODIMENT

Figure 1:
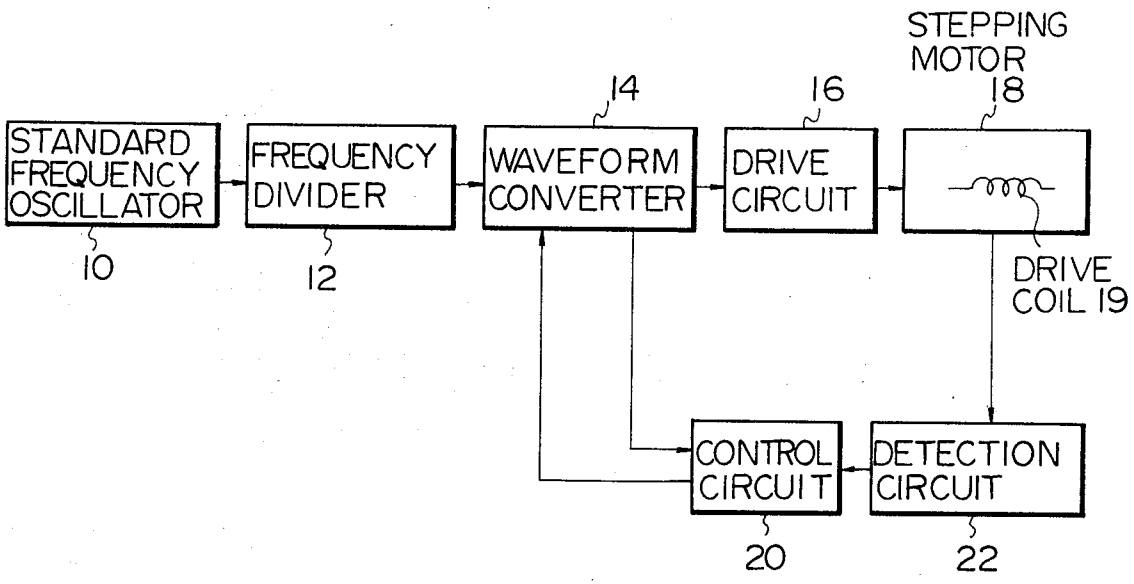
FIG. 1 is a block system diagram of an electronic timepiece incorporating a drive power control system according to the present invention.

Referring first to FIG. 1, a general block diagram is shown therein to illustrate the principal features of an electronic timepiece having a stepping motor drive control system in accordance with the present invention. Reference numeral 10 denotes a standard frequency oscillator circuit which produces a high frequency timebase signal. This signal is applied to a frequency divider circuit 12, which performs frequency division of the timebase signal to produce a unit time signal comprising a pulse train with a period of one second. The unit time signal is applied to a waveform converter circuit 14, together with various other signals produced by frequency divider 12 having a period of less than one second, whereby waveform converter 14 produces one of three different drive input signals. The drive input signal which is selected to be produced by waveform converter circuit 14 is applied to a drive circuit 16, which thereby produces a drive signal to drive a stepping motor 18, with the level of drive power applied by a drive signal being determined by the corresponding drive input signal produced by waveform converter circuit 14. The three possible drive input signals which can be produced by waveform converter 14 comprise a low drive input signal to produce a low power drive signal to operate the stepping motor 18 with a light load applied to motor 18, an intermediate drive input signal for producing an intermediate power drive signal to operate stepping motor 18 with an intermediate level of load applied thereto, and a high drive input signal, for producing a high power drive signal to operate stepping motor 18 with a high level of load applied to the motor. The high power drive signal comprises a train of discrete drive pulses, with a period of one second. The intermediate power drive signal comprises a train of composite drive pulses with a period of one second, each composite drive pulse comprising a plurality of immediately successive sub-pulses having a predetermined duty cycle. The low power drive signal comprises a train of composite drive pulses, with the sub-pulses therein having a duty cycle which is less than that of the intermediate power drive signal. Numeral 20 denotes a control circuit, which receives various input signals from waveform converter 14, as well as an output signal from a detection circuit 22. The latter circuit produces an output signal if the level of an induced voltage in the drive coil 19 of stepping motor 18 is above a predetermined threshold level at a particular point in time following a drive pulse. Depending upon the result of this detection process, control circuit 20 produces signals which select a particular one of the three possible drive input signals to be produced by waveform converter 14.

Immediately following each drive pulse, a short-circuit condition is established across drive coil 19 of stepping motor 18, and this condition is maintained until the commencement of the next drive pulse, with the exception of a brief interval during which an open-circuit condition is established across the terminals of coil 19, in response to signals applied to drive circuit 16 from waveform converter circuit 14. During this open-circuit interval, the induced voltage in drive coil 19, referred to above, is detected by detection circuit 22, which produces an output signal in response if the level of the induced voltage is above the predetermined threshold level. The precise timing of the open-circuit time interval, which shall be referred to hereinafter as a sampling interval, is determined in accordance with whether the system is currently in the high drive signal power, intermediate drive signal power, or low drive signal power generation status.

Figures 2, 2A, 2B:
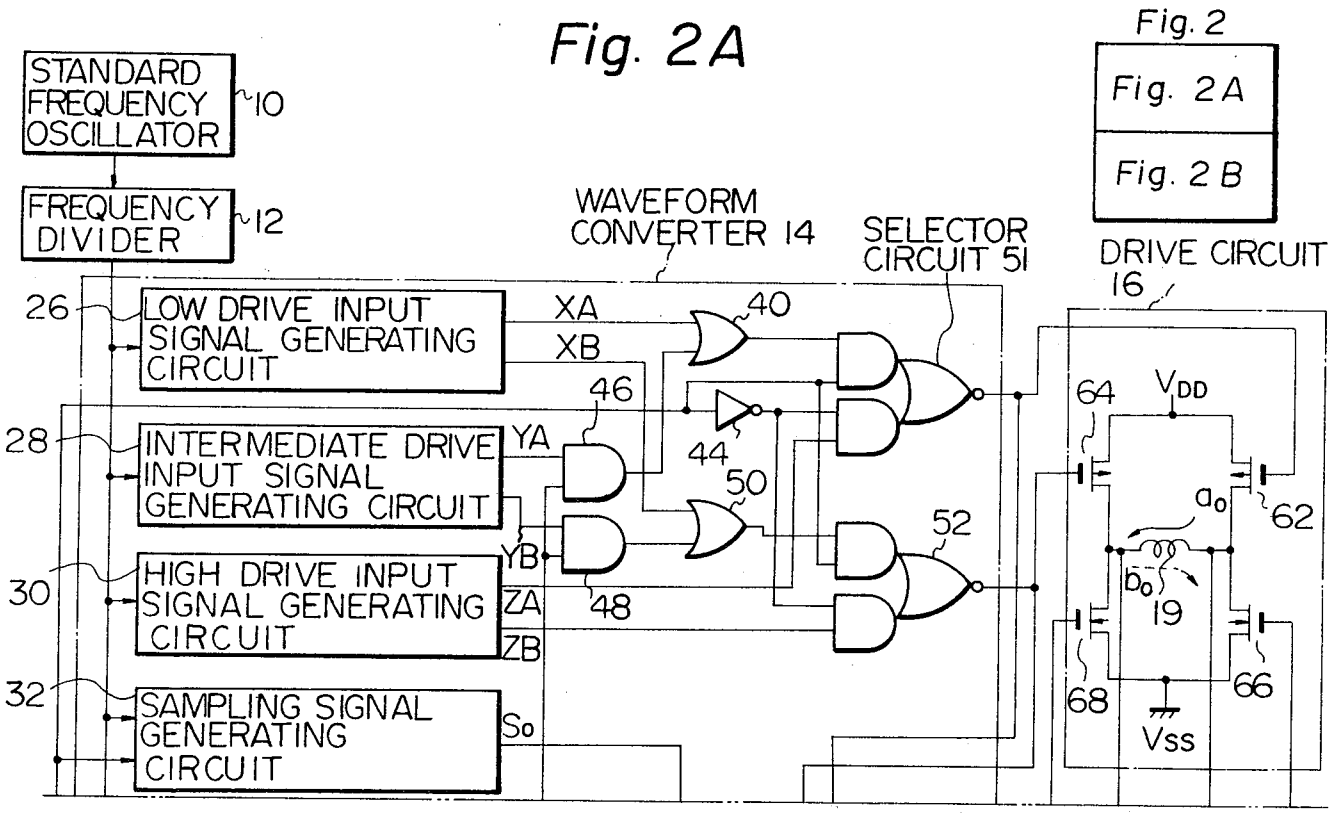
FIGS. 2A and 2B are a block circuit diagram illustrating the major components of an embodiment of an electronic timepiece according to the present invention.
Figure 2B:
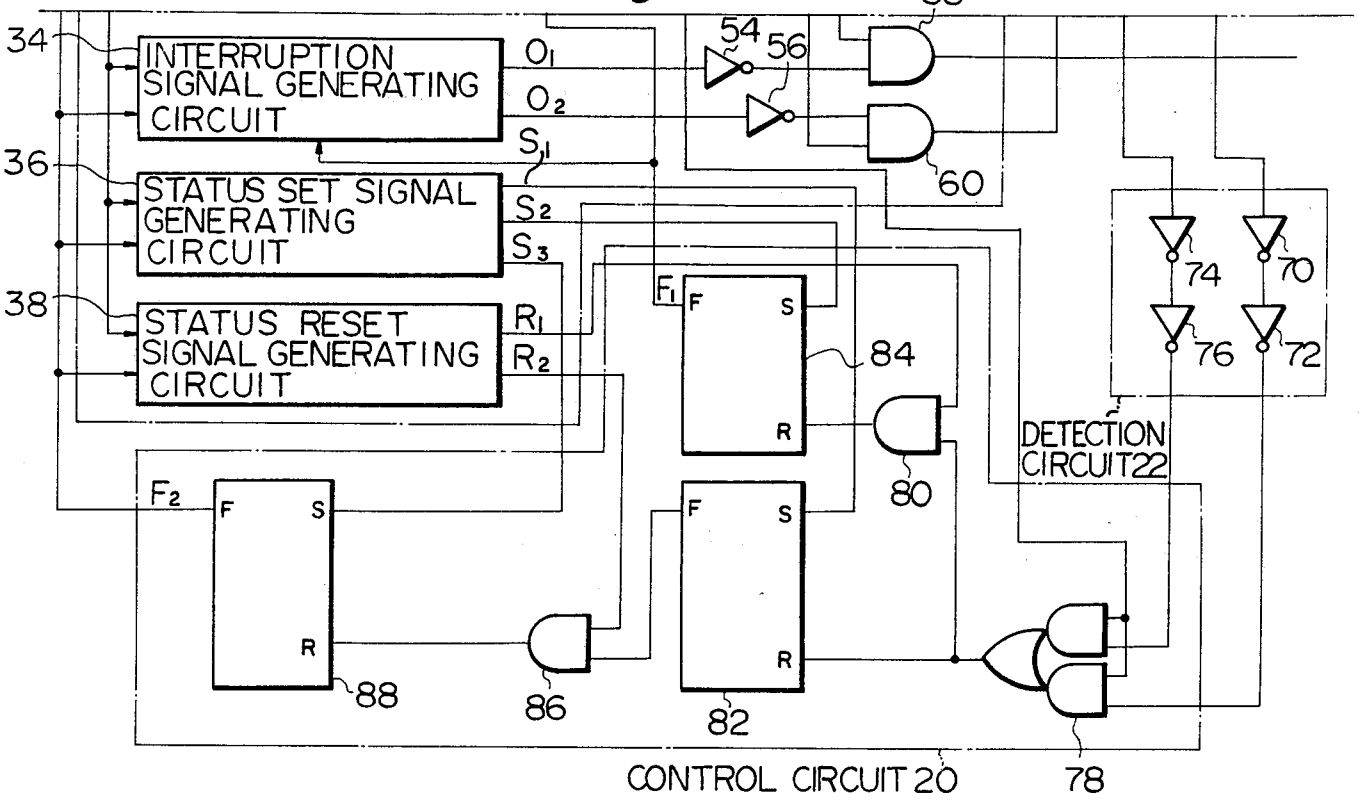

Referring now to FIG. 2, a block circuit diagram is shown therein of an electronic timepiece such as that of FIG. 1, incorporating a stepping motor drive control system according to the present invention. A unit time signal, and various other signals of higher frequency than the unit time signal, are produced by means of a standard frequency oscillator and a frequency divider circuit, 10 and 12, as described with respect to FIG. 1. These signals from frequency divider 12 are applied to a waveform converter 14, which includes a low drive input signal generating circuit 26, a medium drive input signal generating circuit 28, and a high drive input signal generating circuit 30. Waveform converter 14 further comprises an OR gate 40 coupled to receive an output signal XA from low drive input signal generating circuit 26, AND gates 46 and 48 coupled to receive output signals YA and YB respectively from intermediate drive input signal generating circuit 28, an OR gate 48 coupled to receive the outputs from AND gates 46 and 48, an inverter 44 which receives a control signal to be described later, and a selector circuit 51 which selects the output from high drive input signal generating circuit 30 or the output of OR gate 40, in accordance with the logic level of the control signal applied to inverter 44. Waveform converter 14 also comprises a second selector circuit 52, which selects either the output from OR gate 50 or output signal ZB from high drive input signal generating circuit 30. Waveform converter circuit 14 also comprises a sampling signal generating circuit 32, ain interruption signal generating circuit 34, and a status set signal generating circuit 36, together with inverters 54 and 56 for inverting output signals $O_1$ and $O_2$ from interruption signal generating circuit 34, and AND gates 58 and 60. AND gate 58 receives the output from selector circuit 51 and the output from inverter 54. AND gate 60 receives the output from inverter 56, and the output from selector circuit 52.

The drive input signal which is selected by waveform converter circuit 14 (i.e. the output signals from low drive input signal generating circuit 26, a logical OR combination of the outputs from intermediate drive input signal generating circuit 28 and of low drive input signal generating circuit 26, or the output from high drive input signal generating circuit 30) is applied, in inverted form, from the outputs of selector circuits 51 and 52 to input terminals of drive circuit 16. In addition, the inverted outputs from interruption signal generating circuit 34 (referred to hereinafter as interruption signals) are applied through AND gates 58 and 60 to inputs of drive circuit 16.

Drive circuit 16 comprises two P-channel MOS transistors 62 and 64, and two N-channel MOS transistors 66 and 68. The drains of transistors 62 and 66 are connected together, as are the drain terminals of transistors 64 and 68. The source terminals of transistors 62 and 64 are connected together and to a positive supply voltage $V_{DD}$. The source terminals of transistors 68 and 66 are connected together and to the negative supply voltage $V_{SS}$, which represents ground potential. The stepping motor drive coil 19 is connected between the common drain terminals of transistors 64 and 68 and of transistors 62 and 66. Drive input signals are applied from the output of selector circuit 51 to the gate of transistor 62, and from the output of selector circuit 52 to the gate of transistor 64. Interruption signals are applied from the output of AND gate 58 to the gate of transistor 66 and from the output of AND gate 60 to the gate of transistor 68.

Detection circuit 22 is composed of four inverters, 70, 72, 74 and 76. Inverter 70 has its input connected to one end of drive coil 19, while inverter 72 receives the output from inverter 70. Inverter 74 has its input connected to the other end of drive coil 19, while inverter 76 receives the output from inverter 74.

Output signals from detection circuit 22 are applied to control circuit 20. This comprises a selector circuit 78, which receives the output from inverter 72 at one input and the output from inverter 76 at the other input, and is controlled by a sampling signal $S_0$ generated by sampling signal generating circuit 32. Control circuit 20 further comprises an AND gate 80 coupled to receive the output from selector circuit 78 and an output signal $R_1$ from status reset signal generating circuit 34, and a set/reset flip-flop circuit (abbreviated hereinafter to RS FF) 84 which has a reset terminal connected to the output from AND gate 80 and a set terminal connected to receive a signal S2 from status set signal generating circuit 36. A second RS FF, denoted as 82, has a reset terminal coupled to the output of selector circuit 78 and a set terminal coupled to receive a signal S1 from status set signal generating circuit 36. The output from RS FF 82 is connected to one input of an AND gate 86, which receives a signal R2 from status reset signal generating circuit 38 at its other input. The output of AND gate 86 is connected to the reset terminal of a third RS FF denoted by numeral 88. RS FF 88 receives signal S3 from status set signal generating circuit 36 at its set terminal. The output signal from RS FF 84 is designated as control signal $F_1$, while the output signal from RS FF 88 is designated as control signal $F_2$.

Figure 3:
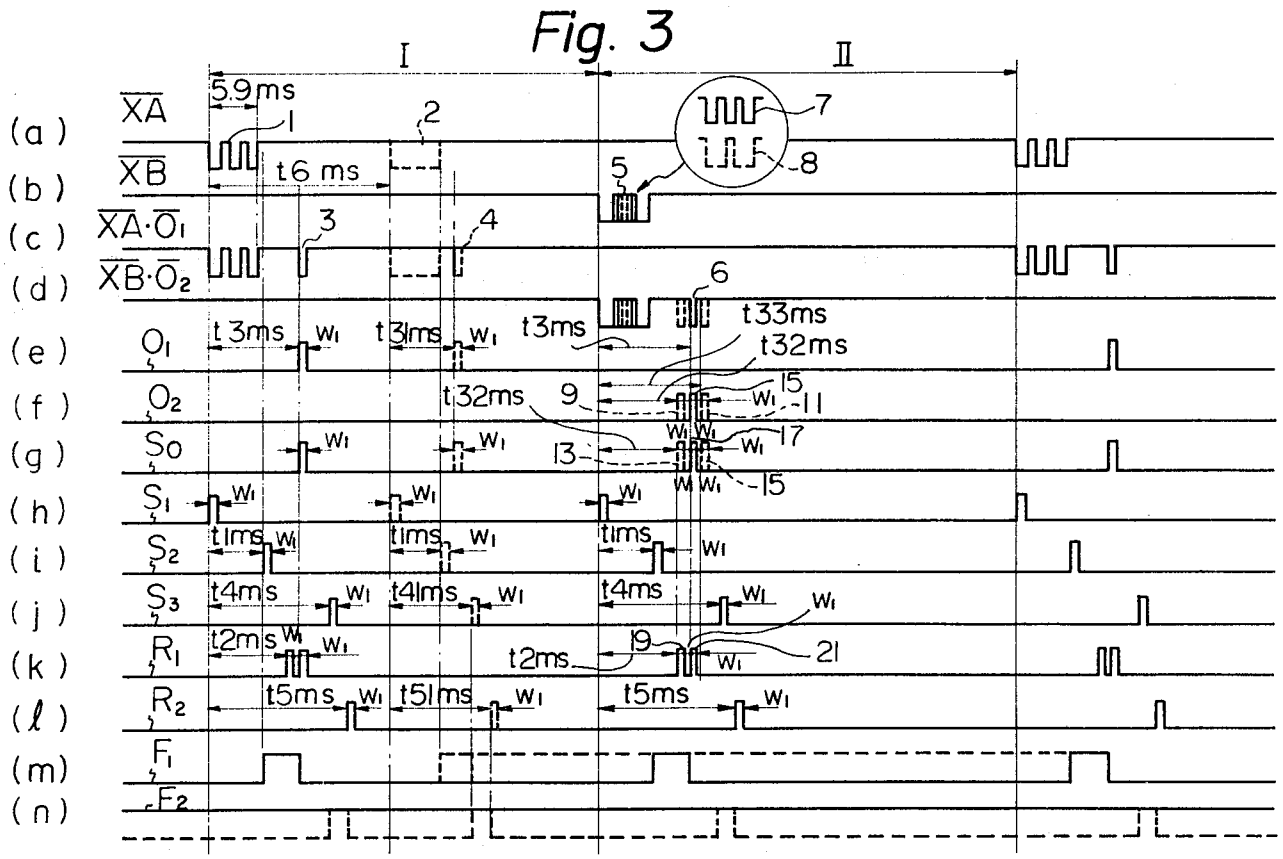
FIG. 3 is a timing diagram illustrating various waveforms of the circuit of FIG. 2.
Figure 4:
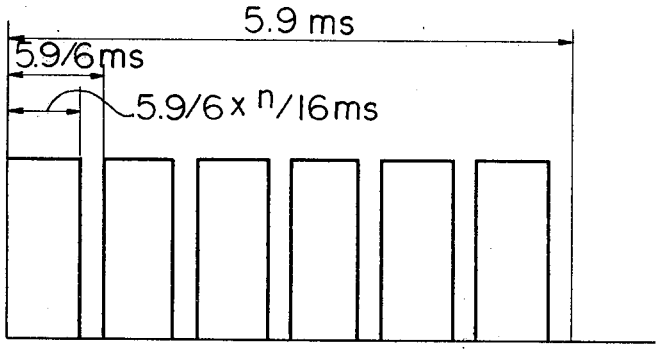
FIG. 4 is a waveform diagram illustrating the configuration of a composite drive pulse for a system according to the present invention.

The operation of the circuit of FIG. 2 will now be described, with reference to the timing chart of FIG. 3 and the waveform diagram of FIG. 4. In FIG. 3, two successive drive intervals, each of one second duration, are denoted by the numeral I and II. It will be assumed that, prior to time interval I, the stepping motor 18 has been operating under a light load, i.e. the stepping motor has been driving only the seconds, minutes and hours hands of the timepiece. As a result, low level drive input signal XA produced by input signal generating circuit 26 is output from selector circuit 51, in inverted form. This is the first of the composite pulse groups $\overline{XA}$ in FIG. 3, indicated by numeral 1. Another group of composite drive input pulses is produced from AND gate 58 at this time, in synchronism with the output from selector circuit 51. Each of these composite drive input signals, $\overline{XA}$ and $XA.\overline{O}_1$ from selector circuit 51 and AND gate 58 respectively has a duration of 5.9 ms, and is composed of a group of negative-going pulses. During these pulses, the output from selector circuit 52, i.e. signal $\overline{XB}$ is at the high logic level potential (referred to hereinafter as the H level). As a result, each time signals $\overline{XA}$ and $XA.\overline{O}_1$ go the the low logic level potential (referred to hereinafter as the L level) in synchronism, transistor 66 of drive circuit 16 goes from the ON state (i.e. the state in which there is an effective short-circuit established between the drain and source electrodes) to the OFF state (i.e. the state in which there is an effective open-circuit condition between drain and source). Simultaneously, transistor 62 goes from the OFF state to the ON state each time signal $\overline{XA}$ goes to the L level. Thus, a current flows from the $V_{DD}$ side of the power source (i.e. the H level) through transistor 62 and through the drive coil 19, then through transistor 68 (whose gate electrode is at the H level) to the $V_{SS}$ side of the power source, i.e. to the L level. Thus, each time signal $\overline{XA}$ goes to the L level, in a composite drive input pulse group, a corresponding drive pulse is applied to drive coil 19, i.e., a composite drive pulse group is applied to stepping motor 18.

Because of the symmetrical configuration of drive circuit 16, it will be apparent that precisely the same sequence of events as described above will occur when a composite drive input pulse group is output from selector circuit 52, as signal $\overline{XB}$. In this case, each time signal $\overline{XB}$ (and hence signal $XB.O_2$) to the L level, a drive pulse will be applied to drive coil 19 from drive circuit 16 such that current flows from the H level, through transistor 64 and drive coil 19, then through transistor 66, to the L level.

After the termination of each drive input pulse group, signals $\overline{XA}$ and XB remain at the H level until the next drive pulse is produced. In this condition, each of transistors 66 and 68 is in the ON state so that an effective short-circuited condition is established between the terminals of drive coil 19, since transistors 66 and 68 are P-channel types. Since transistors 62 and 64 are N-channel types, an open-circuit condition is established between the H level potential and the drive coil 19 between successive drive pulses.

The process of detecting the level of load upon stepping motor 18 will now be described. After a time interval of duration $t_3$ after the initation of a drive input pulse, a positive-going pulse of width $w_1$ is produced by interruption signal generating circuit 34. This pulse is designated as $O_1$, and is applied to the input of AND gate 58, after being inverted by inverter 54. As a result, the output from AND gate 54 goes momentarily from the H level to the L level for a time interval $w_1$, as shown in FIG. 3, during interval I. As a result, the short-circuit condition between the terminals of drive coil 19 is momentarily interrupted, since transistor 66 is momentarily set into the OFF state. As induced spike voltage is thereby produced in drive coil 19, due to the motion of the rotor of stepping motor 18 following the drive pulse 1 at the start of time interval I. If the level of this voltage spike is sufficiently high, the threshold voltage of inverter 70 in detection circuit 22 will be exceeded, and as a result a positive-going pulse will be produced by inverter 72. At this time, a sampling signal pulse $S_0$ is produced by sampling signal generating circuit 32, synchronized with interruption signal $O_1$. An output pulse is thereby produced by selector circuit 78 of control circuit 20, which is applied to the reset terminal of RS FF 82. Previously, at the start of time interval I, RS FF 82 has been set to the H level output state, by means of a set pulse $S_1$. However, if the level of output voltage from drive coil 19 during the sampling pulse $S_0$ is sufficiently high, then the resultant output pulse from selector circuit 78 resets RS FF 82 to the L level output state. Also during time interval I, status reset signal generating circuit 38 produces two consecutive reset pulses, designated as $R_1$, the first of which begins after a time interval $t_2$ from the start of the time interval I, and the second of which is coincident with sampling pulse $S_0$. Thus, if an output pulse is produced from selector circuit 78 during sampling pulse $S_0$, then an output is produced from AND gate 80 at this time, which serves to reset RS FF 84, so that signal $F_1$ goes to the L level. Signal $F_1$ has been previously set to the H level output state by a pulse $S_2$ applied from set signal generating circuit 36, the latter pulse being produced after a time delay $t_1$ from the start of time interval I.

Status set signal generating circuit 36 also produces a pulse $S_3$, after a delay of $t_4$ from the start of period I. This pulse is applied to the set terminal of RS FF 88. In the example of time interval I in FIG. 3, it is assumed that the RS FF 82, which is set by a pulse $S_1$ at the start of time interval I, is reset by the output from selector circuit 78. Thus, AND gate 86 is inhibited from producing an output to reset RS FF 88, so that signal $F_2$ remains at the H level during time interval I. As a result, selector circuit 52 of waveform converter 14 is enabled to pass drive input signal XB, from OR gate 50, to drive circuit 16 at the start of the next one-second time interval II.

The above is the sequence of operation if a normal load is being continuously applied to stepping motor 18. Before describing the modes of operation in different load statuses, the waveform of the drive input signals produced by signal generating circuits 26 and 28 will be discussed. As stated above, during normal load operation of the system, drive input pulses, and hence drive pulses, are produced in the form of composite pulse groups, composed of a number of sub-pulses. Such a composite pulse group is shown in FIG. 4. In this embodiment, the duration of the composite pulse group is 5.9 ms, In the present embodiment, such composite drive pulses are employed when stepping motor 18 is driving a load of light or intermediate level. When stepping motor 18 is driving a heavy load, then continuous drive pulses are applied, to ensure maximum shaft torque. The use of composite pulse groups as drive signals serves to enhance the transducing efficiency of stepping motor 18, when the motor is not being driven at maximum output power level.

In the present embodiment, each composite drive pulse group comprises a number of sub-pulses, each of 12/16 ms, in the case of the low drive signal resulting from the drive input signals XA and XB. For the case of an intermediate level load being applied to stepping motor 18, an intermediate drive signal is generated wherein the sub-pulses of each composite drive pulse group are of 13/16 ms duration. For the case of high-power drive, drive pulses each having a continuous duration of 5.9 ms are employed. The intermediate drive input pulse groups are actually produced by combining the output signal YA and YB from intermediate drive signal generating circuit 28 to the signals XA and XB respectively from low drive input signal generating circuit 26, in OR gates 40 and 50 respectively, of waveform converter circuit 14. For the sake of simplicity, the low level and intermediate level drive input pulse groups are shown in FIG. 4 as comprising only four and two (negative-going) pulses respectively, as indicated by numerals 7 and 8. Here, the intermediatel drive input pulse group 7 is shown in broken-line outline.

Figure 5:
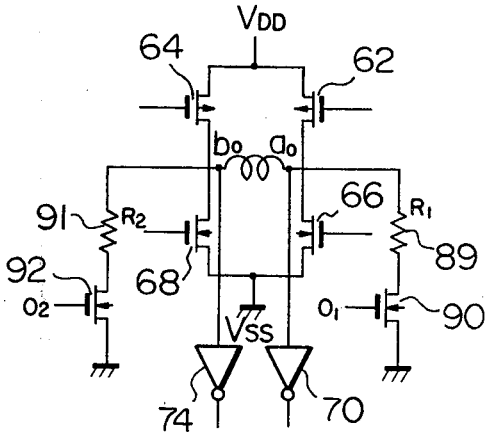
FIG. 5 is a circuit diagram of a modified driver circuit for an electronic timepiece according to the present invention.

As stated hereinabove, with the embodiment of FIG. 2, an open-circuit condition is established across the terminals of drive coil 19 when an interruption signal $O_1$ or $O_2$ is applied (through inverter 54 and AND gate 58, or through inverter 56 and AND gate 60) to drive circuit 16. However, in order to ensure the greatest possible consistency in the amplitude of the voltage spikes generated across drive coil 19 during a sampling interval, it is possible to modify the embodiment of FIG. 2 as shown in FIG. 5, such as to connect a high resistance of known value across drive coil 19 during each interruption pulse $O_1$ an $O_2$. In the modified circuit of FIG. 5, a P-channel transistor 90 is connected in series with a high value resistor 89, with the drain of transistor 90 connected to resistor 89 and the drain of transistor 90 connected to the L level potential. The other end of resistor 89 is connected to the junction of drive coil 19 with the common drain connections of transistors 62 and 66. Similarly a high resistor 91 is connected in series between the drain of a P-channel transistor 92 and the other end of drive coil 19. Interruption pulse signals $O_1$ and $O_2$ are applied to the gate terminals of transistors 90 and 92 respectively. Thus, during each interruption pulse, one end of drive coil 19 is connected to the L level potential (through transistor 66 or 68, while the other end of the drive coil is connected to the L level through a high resistance (resistor 89 or 91).

Figure 6:
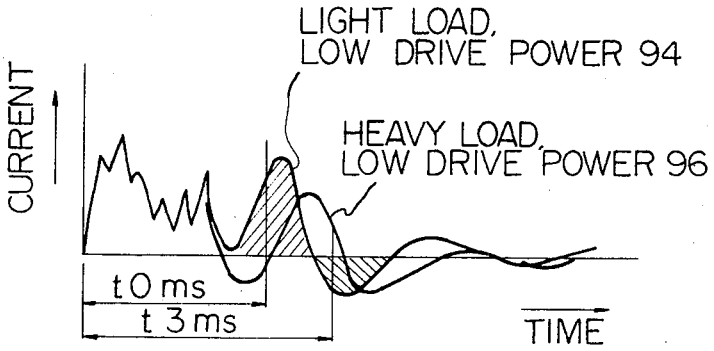
FIG. 6 is a waveform diagram illustrating the current flowing in a drive coil of a stepping motor during and after application of a low power drive pulse.

The operation of the circuit of FIG. 3 will now be described for the various cases of changes in the load applied to stepping motor 18. Before doing so, the currents and voltages induced in drive coil 19 following a drive pulse will be discussed. It should be noted that the term "drive pulse" as used herein refers to either a single continuous pulse or to a composite drive pulse group composed of several subpulses. Referring first to FIG. 6, the waveforms of current induced in drive coil 19 when a low level drive pulse is applied are indicated, for the case of a low level drive pulse. Numeral 94 indicates the current waveform for the case of a light load being applied to stepping motor 18 during the drive pulse, while numeral 96 shows the waveform for the case of a heavy load being applied. As shown, a series of cycles of oscillation occur in each case, of gradually decreasing amplitude. It can be seen that there is a delay in phase, for the case of a heavy load being applied, by comparison with the current waveform for a light load being applied.

Figure 7:
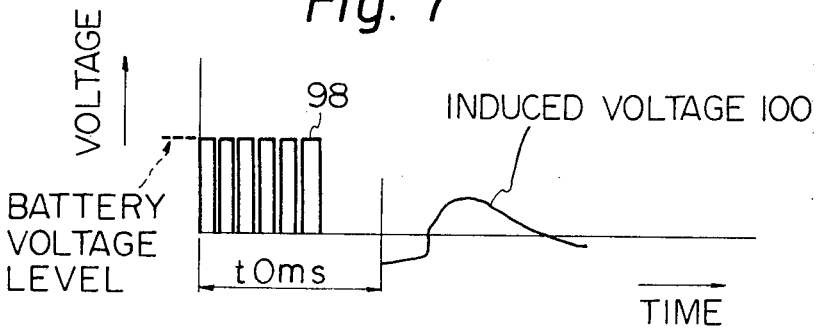
FIG. 7 is a waveform diagram illustrating the induced voltage appearing across a drive coil of a stepping motor when the coil terminals are open-circuited following a drive pulse of low power.

FIG. 7 is a graph illustrating the voltage appearing across drive coil 19, for the case of a light load being applied and low level drive pulse being delivered. Numeral 98 indicates the waveform of the drive pulse voltage, while numeral 100 indicates the waveform which would appear if an open circuit condition were established between the terminals of drive coil 19, beginning after a time delay $t_0$ from the start of drive pulse 98 and being maintained thereafter. Since the time scales of FIG. 6 and FIG. 7 are identical, the relationship between the crrent flowing in drive coil 19 if a short-circuit condition is maintained after a drive pulse, and the voltage which develops across the drive coil if it is placed in an open-circuit condition can be clearly see.

Figure 8:
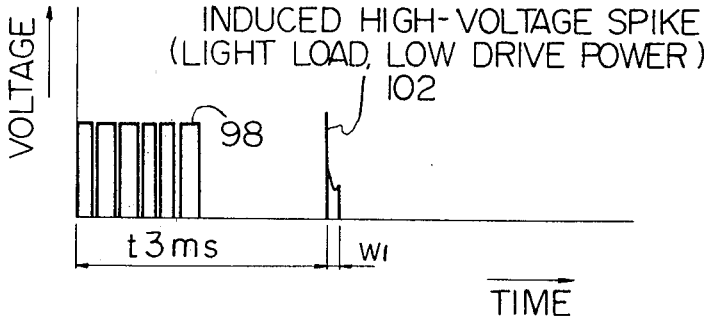
FIG. 8 is a waveform diagram illustrating the induced voltage appearing across a drive coil of a stepping motor when the coil terminals are open-circuited during a detection interval of brief duration, under low drive power.

FIG. 8 illustrates the corresponding voltage waveforms for the case of a drive coil short-circuit condition being interrupted for a time interval $w_1$, of brief duration, beginning after a delay of $t_3$ from the start of drive pulse 98, i.e. during the first negative-going excursion of the current waveform 94 shown in FIG. 6. As shown, a voltage spike of relatively high amplitude is produced initially, as denoted by numeral 102, for the case of interruption when a light load is being applied to stepping motor 19 and immediately succeeding a low level drive pulse.

Figure 9:
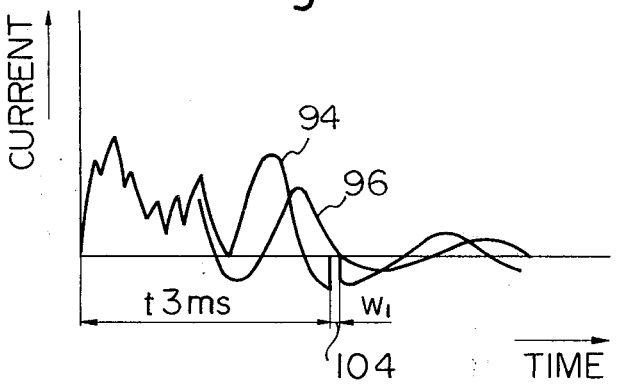
FIG. 9 is a waveform diagram illustrating the current flows in a stepping motor drive coil when low drive power is applied and the drive coil terminals are momentarily open-circuited after a drive pulse.

If now, while stepping motor 18 is being driven by successive low-level drive pulses the load applied to the motor shaft should increase to a high level, then the phase of the oscillations in drive coil current waveform will be delayed, to waveform 96 shown in FIG. 6. As a result, the amplitude of the voltage spike produced when the drive coil is open-circuited, at time $t_3$ will be considerably reduced. This can be appreciated by referring to FIG. 9, which shows how there is a sudden decrease in the current flow through the drive coil 19 when sampling occurs after time $t_3$, in the case of a light load being applied to motor 19, as indicated by numeral 104. It will be apparent that, if the flow of current is interrupted at that same time (i.e. after a delay of $t_3$ with respect to the start of a drive pulse, for the case of a heavy load being applied to motor 18, then the resultant change in current will be considerably smaller, or of opposite polarity. Thus, the resultant voltage spike produced across drive coil 19 will be correspondingly small.

The operation of the circuit of FIG. 2 for the case of a change from a light load to a high load level applied to stepping motor 18 during low-level drive will now be described. We shall assume that the load applied to motor 18 has increased immediately before the start of period I in FIG. 3. As before, a drive pulse 1, for low level drive power, will be produced. This may or may not be of sufficient power to rotate the rotor of stepping motor 18 from one stable position to the next. If the rotor is in fact rotated by this first drive pulse 1, then a current waveform as denoted by numeral 96 in FIG. 6 and FIG. 9 will flow in drive coil 19, following the drive pulse 1. When interruption pulse $O_1$ causes the flow of current in drive coil 19 to be interrupted after time $t_3$, the voltage spike which is thereby applied to the input of inverter 70 will be below the threshold voltage of this inverter. As a result, no pulse will be produced by inverter 72 of detection circuit 22 at the timing of sampling pulse $S_0$. Thus, no output will be produced by selector circuit 78 of control circuit 20 at this time, so that RS FF 82, previously set by pulse $S_1$, remains in the set state. Thus, when pulse $R_2$ from status reset signal generating circuit 38 is produced, after time $t_5$ from the start of drive pulse 1, an output pulse is produced by AND gate 86. This resets RS FF 88, so that signal $F_2$ goes to the L level. This is indicated by a dotted line in FIG. 3. Prior to this, RS FF 84, which was set by pulse $S_2$ after time $t_1$, will remain in the set state, since AND gate 80 will not receive a pulse from selector circuit 78 at the timings of pulses $R_1$. However, this set state of RS FF 84 is not important in the present case, as will be subsequently made apparent.

Since signal $F_2$ is at the L level, Selector circuit 51 in waveform converter 14 will be inhibited, from passing the output from OR gate 40, i.e. signal XA and YA. Similarly, selector circuit 52 is inhibited from passing the output of OR gate 50. Selector circuits 51 and 52 are enabled by the output signal from inverter 44 to pass the high level drive input signals ZA and ZB respectively. In response to the transition of signal $F_2$ to the L level state after time delay $t_5$ from the start of drive pulse 1, in FIG. 3, a high level drive input pulse ZA is produced by high drive input signal generating circuit 30 after a delay of $t_6$ from the start of period I. A set of pulses $O_1$, $S_0$, $S_1$, $S_2$, $S_3$ and $R_2$ are also produced, with the timings shown in FIG. 3, these pulses being drawn in dotted lines within the time interval I.

When the high level drive pulse resulting from the drive input pulse denoted by numeral 2 in FIG. 3 is applied to stepping motor 18 during time interval I, then one of two events can occur. If the preceding low-level drive pulse at the start of interval I was of insufficient amplitude to rotate the rotor of stepping motor 18 from one stable position to the next, then rotation of the rotor will be accomplished by the high level drive pulse which is produced after time delay $t_6$ from the start of interval I. (It should be noted here that the result of failure of a drive pulse to rotate the rotor of motor 18 will be exactly the same as rotation of the rotor in response to a low level drive pulse when the motor 19 is under heavy load, i.e. in both cases the amplitude of voltage appearing across drive coil 19 at the time of sampling will be below the threshold voltage of the corresponding inverter 70 or 74 of detection circuit 22.) If on the other hand, the low level drive pulse at the start of period I was sufficiently powerful to rotate the rotor of motor 18, then the relationship between the stator and rotor of motor 18 will be such that, when a high level drive pulse is applied after time delay $t_6$, no rotation of the rotor will occur. In each case, once the presence of a high load level applied to motor 18 has been detected, thereafter high level drive pulses will be produced, the first being produced after a predetermined delay time after the low level drive pulse following which detection of the load change was performed, and with subsequent high level drive pulses being applied at the start of each one-second period.

Figure 10:
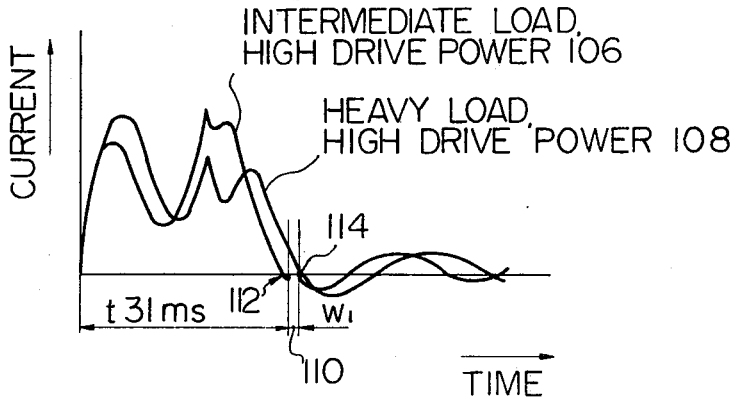
FIG. 10 is a waveform diagram illustrating the current flow in a stepping motor drive coil when high drive power is applied.
Figure 11:
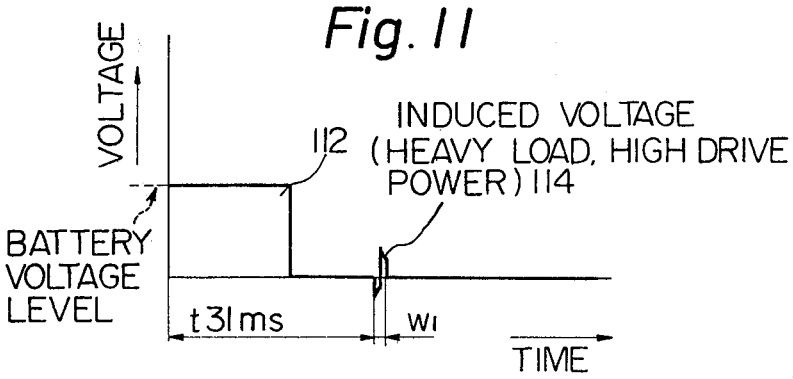
FIG. 11 is a waveform diagram showing the voltage induced in a drive coil during a detection interval, when the stepping motor is driven at a high power level.

Referring now to the current waveforms shown in FIG. 10, numeral 108 shows the current flowing through drive coil 19 during and immediately after a high level drive pulse is applied, with a heavy load being applied to stepping motor 18. The timing of a an interruption pulse $O_1$ or $O_2$ is delayed by time $t_{31}$ with respect to the start of the high power drive pulse. In the present embodiment, time $t_{31}$ differs from the time delay $t_3$ after which interruption and sampling are performed following a low level drive pulse. However, depending upon the particular characteristics of the stepping motor, it may be possible to arrange that time delays $t_3$ and $t_{31}$ are identical. It can be seen that when interruption of current waveform 108 occurs after time $t_{31}$, the current level is very low. Thus, the voltage induced in drive coil 19 when interruption occurs will be below the threshold level of detection circuit 22. Thus, following application of a high level drive pulse, with a heavy load applied to motor 18, no output will be produced from selector circuit 78 when sampling signal $S_0$ is applied thereto. The RS FF 82 will therefore remain in the set state, so that the RS FF 88 is maintained in the reset state (or rather, is briefly set by pulse $S_3$ after time delay $t_{41}$ from the start of the drive pulse, and then is reset by pulse $R_2$ after time delay $t_{51}$ from the start of the drive pulse, as illustrated by the broken line portions of the timing chart in period I of FIG. 3). As a result, the generation of high level drive input pulses from waveform converter 14, and hence of high level drive pulses from drive circuit 16, occurs at the start of each one-second interval, so long as a heavy load is being applied to motor 18.

The circuitry whereby the timing of signals ZA, ZB, $O_1$, $O_2$, $S_0$, $S_1$, $S_2$, $S_3$ and $R_2$ are varied according to whether a high load has been detected while in the low drive signal condition or whether a high load is being applied with high level drive signals being produced, will not be described. Such circuitry can obviously be readily implemented by conventional techniques, and actuated in response to logic level transistions of signal $F_2$.

The case in which a transition from a heavy load to an intermediate load level on motor 18, while in the high drive signal level status, will now be described. The current waveform in such a case is denoted by numeral 106 in FIG. 10. As shown, the phase of the oscillations of current flow in drive coil 19, occurring due to free oscillation of the rotor of motor 18, is advanced, relative to the current waveform for the high load condition. When interruption of the drive coil current now occurs after time $t_{31}$, a voltage spike of appreciable magnitude will be induced in drive coil 19, so that an output pulse from detection circuit 22 causes an output to be produced from selector circuit 78 of control circuit 20. As a result, RS FF 82 is reset, thereby inhibiting AND gate 86. Thus, when RS FF 88 is set by pulse $S_3$, it will remain in the set state thereafter, so that signal $F_2$ will remain at the H level. Since the output of inverter 44 in waveform converter 14 is now at the L level, further output of high level drive input signals to drive circuit 16 is prevented. Also when the output of selector circuit 78 goes to the H level, there is no $R_1$ pulse produced at the same time. Thus, the output of AND gate 80 remains at the L level. The output of RS FF 84, previously set to the H level by pulse $S_2$, therefore remains at the H level, i.e. signal $F_1$ is held at the H level. AND gates 46 and 48 are thereby enabled to pass signals YA and YB respectively to the selector circuits 51 and 52 respectively, through OR gates 40 and 50 in which signal YA is combined with signal XA and signal YB is combined with signal XB. The result is to produce an intermediate drive input signal, composed of a composite group of sub-pulses which have a higher duty cycle than the sub-pulses composing a low drive input pulse, as indicated by numeral 8 in FIG. 3. As indicated, the number of sub-pulses composing an intermediate drive input pulse is less than the number of sub-pulses which comprise a low drive input pulse, in this embodiment. In FIG. 3 the various waveforms for the case of the low level drive status are drawn in solid lines, while the corresponding waveforms for the case of intermediate level drive status are drawn in broken lines.

Figure 12:
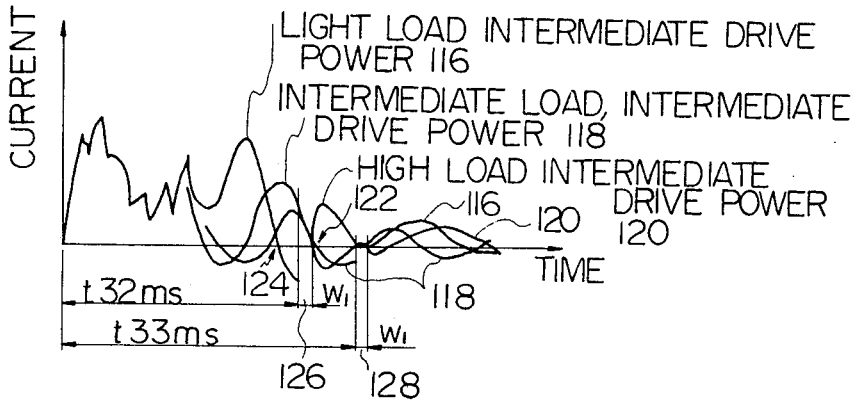
FIG. 12 is a waveform diagram illustrating various current flows in a stepping motor drive coil when the motor is driven at an intermediate power level.
Figure 13:
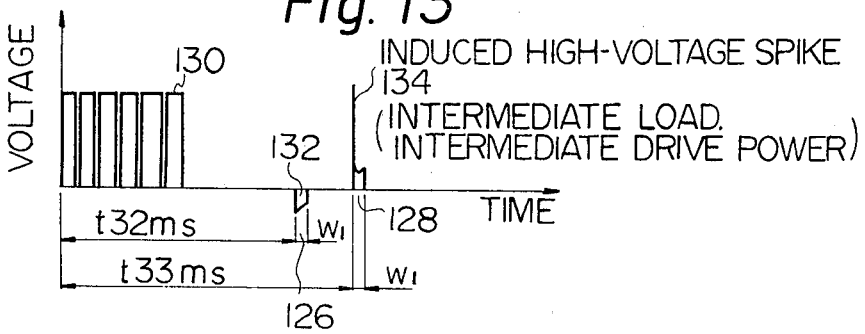
FIG. 13 and FIG. 14 are waveform diagrams illustrating voltages induced in the stepping motor drive coil during detection intervals following intermediate power level drive pulses.

The case of an intermediate level load being applied while intermediate level drive pulses are being produced will now be discussed, referring to FIG. 12. Here, numeral 118 denotes the current waveform during and after application of an intermediate level drive pulse to motor 18, with an intermediate level load applied. In this operating status, the timing of interruption of drive coil current is performed after a delay of $t_{33}$, while a substantial current is flowing in drive coil 19, so that a voltage spike of appreciable magnitude is produced. Such a voltage spike is illustrated in FIG. 13, denoted as numeral 134. It is a feature of this intermediate drive status that two consecutive interruption pulses $O_1$ or $O_2$ are produced (and two corresponding sampling pulses $S_O$) at timings $t_{32}$ and $t_{33}$ respectively. However if the load is of intermediate level, then the timing of the first interruption pulse is such that only a very small voltage spike is produced, as indicated by numeral 132 in FIG. 13, which does not exceed the detection threshold of detection circuit 22.

After time $t_{33}$, therefore, an output signal is produced by detection circuit 22, which produces a pulse from selector circuit 78. RS FF 82 is thereby reset, so that the output of AND gate 86 is held at the L level, ensuring that the output of signal $F_2$ from RS FF 88 will be maintained at the H level. In addition, since neither of the two $R_1$ pulses coincides with the output pulse from selector circuit 78 at time $t_{33}$, no output is produced by AND gate 80 at this time. Thus, RS FF 84 remains in the set state, so that signal $F_1$ is held at the H level. As explained hereinabove, when signals $F_1$ and $F_2$ are both at the H level, then intermediate level drive input pulses are produced by waveform converter 14. Thus, while the system is operating in the intermediate drive status, with an intermediate level of load applied to motor 18, intermediate drive pulses will continue to be applied to motor drive coil 19.

Figure 14:
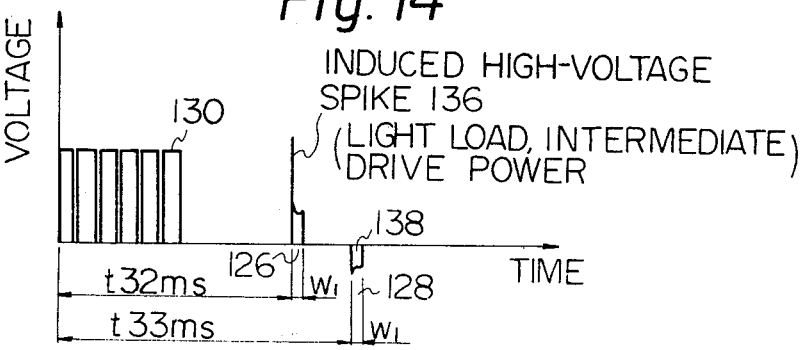

The case in which the level of load applied to motor 18 goes to the light load condition, while the system is operating in the intermediate drive status, will now be described. In this case, the drive coil current waveform will typically be as shown in FIG. 12, denoted by numeral 116. It can be seen that in this case, when the drive coil current is interrupted after time $t_{32}$ from the start of a drive pulse, an appreciable current will be flowing in the drive coil, so that a large magnitude voltage spike will be produced at this time, as indicated by numeral 136 in FIG. 14. Thus, for the case shown in time interval II of FIG. 3, an output pulse is produced by selector circuit 78 at time $t_{32}$, so that RS FF 82 is reset to hold signal $F_2$ at the H level. The first of the $R_1$ pulses produced in time interval II, after delay $t_2$ from the start of the interval, overlaps the output signal from selector circuit 78, so that an H level output pulse is produced by AND gate 80. This resets RS FF 84, so that signal $F_1$ goes to the L level. Thus, signals YA and YB are inhibited from being transferred by AND gates 46 and 48, so that subsequent drive pulses will be at the low drive level. In addition, the low level state of signal $F_1$ causes the timing of signals $O_1$, $O_2$, $S_0$, $S_1$, $S_2$, and $S_3$ to be altered to the values shown in period I of FIG. 3. In other words, the system has now entered the low drive status of operation, described hereinabove.

If on the other hand a high load level is applied to motor 18 while the system is operating in the intermediate drive status, then at the timing of each interruption signal pulse $O_2$ (for the example of period II in FIG. 3) the level of current flow in drive coil 19 will be very low. This is illustrated in FIG. 12, where the drive coil current waveform in this case is denoted by numeral 120. As a result, no output will be produced from detection circuit 22, and hence from selector circuit 78, following the intermediate drive pulse. As a result, AND gate 86 will be enabled by the output from RS FF 82 at the timing of the next $R_2$ pulse, so that RS FF 88 will be reset, causing signal $F_2$ to go to the H level. Accordingly, a high level drive pulse will be produced, after a delay of $t_6$ from the start of the intermediate drive pulse, as explained hereinabove for period I of FIG.3. Thereafter, a high level drive pulse will be applied to stepping motor 18 at the start of each one-second period.

The other possible cases which may occur are as follows. First, if an intermediate level load is applied to motor 18 while the system is operating in the low power drive status, then a high level drive pulse will first be produced, and thereafter only intermediate level drive pulses will be produced. Second, if the load applied to motor 18 is reduced to a light load level while the system is operating in the high power drive status, then one intermediate level drive pulse will be produced, and thereafter low level drive pulses will be applied to motor 18. The sequence of events in each of these cases will be obvious from the preceding description of the circuit of FIG. 2.

Figure 15:
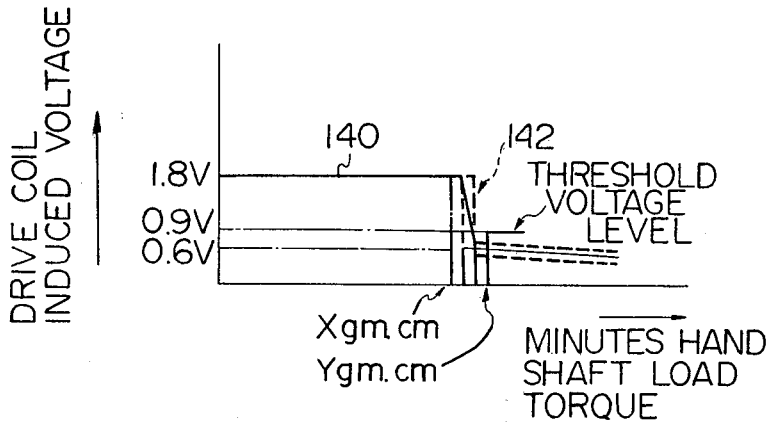
FIG. 15 is a diagram illustrating the relationship between the voltage induced in a stepping motor drive coil following a drive pulse and the level of load torque being applied to the motor.

Referring now to FIG. 15, a graph is shown therein which illustrates a typical relationship between the load torque applied to the shaft of a timepiece stepping motor and the amplitude of a voltage spike induced in the drive coil when the current flowing therein is interrupted following the termination of a drive pulse. The graph of FIG. 15 is for the case of operation in the high drive power status, in which interruption of the drive coil current is performed for a duration of $w_1$ following a delay of $t_{31}$ from the start of a drive pulse, as indicated by the broken-line portions of waveforms (a) and (b) of FIG. 3 during time interval I. It can be seen that, so long as the shaft load torque is greater than a certain value, designated as Y gram-centimeters (abbreviated herein to gm.cm), then the amplitude of the induced drive coil voltage is less than approximately 0.6 V. When the load torque has fallen to below a level designated as X gm.cm, then the amplitude of the induced voltage rises to approximately 1.8 V. The actual values of the induced voltage will vary, depending upon such factors as the efficiency of transmission by the timepiece gear train, and the range of variation of the induced drive coil voltage is indicated by the broken-line outline in FIG. 15. It has been found that, if the load has a value which is between X gm.cm and Y gm.cm, then an induced voltage of approximately 0.6 V and an induced voltage of approximately 1.8 V will be generated at least once per minute. However, if the amount of fluctuation in transmission efficiency of the stepping motor is relatively small, then it has been found that there will be a difference of less than 0.3 gram between the load torque which will result in the continuous generation of 1.8 V induced voltage when drive coil current is interrupted and the load torque which will result in continuous generation of a 0.6 V induced voltage.

If the threshold voltage of inverters 70 and 74 of detection circuit 22 is set to a value between 0.7 V and 1.1 V, then so long as the load torque on the motor has a value greater than Y gm.cm, there will be no changeover from the high drive power status to the intermediate drive power status. However, if the load torque reaches a value of (Y−0.1) gm.cm, then an induced voltage of approximately 1.8 V will be generated by the drive coil at least once per minute. Each time this occurs, there will be a changeover to intermediate drive power status, from the start of the next one-second interval. If the load torque falls below X gm.cm, then there will be an immediate changeover to the intermediate drive power status, from the start of the next one-second period. To summarize, the system can command a changeover from the high drive power status to the intermediate drive power status, in response to a change in load of only 0.1 gm.cm. The same is true for a changeover from the low to the high drive power status, from the intermediate to the low drive power status, and from the intermediate to the high drive power status.

It should be noted that the term "status" as used in the present specification and in the appended claims refers to a condition in which a predetermined type of drive pulse is produced at the start of each one-second period and in which the various other interruption, sampling, set and reset signals describe hereinabove are produced at predetermined timings with respect to that type of drive pulse, these timings being varied in accordance with whether the drive pulse is of low, intermediate, or high level.

The points at which changeover from one drive status to another occur can be changed by adjusting the timing at which interruption of the drive coil current is performed following each drive pulse, i.e. the timing of interruption pulses $O_1$ and $O_2$ in the prefered embodiment. For example, if it is desired to produce an increase in the load level at which changeover from one drive power status to the next highest occurs, this can be done by increasing the delay of the interruption pulse relative to the drive pulse. If it is desired to decrease the load level at which changeover from one drive power status to the next lower status occurs, this can be done by reducing the delay of each interruption pulse relative to the preceding drive pulse.

Figure 16:
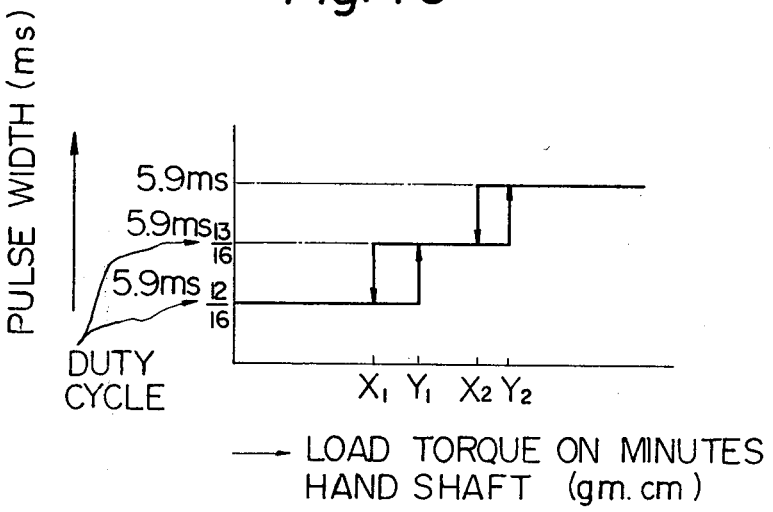
FIG. 16 is a graph showing the relationship between drive power applied to the stopping motor and the load torque applied to the motor, for the embodiment of the present invention shown in FIG. 2.

FIG. 16 is a graph illustrating the relation between load torque on stepping motor 18 and power which is delivered to the stepping motor by each drive pulse. In the case of maximum drive power, each drive pulse is a continuous pulse with a duration of 5.9 milliseconds (ms). For intermediate drive power, each drive pulse is a composite group of pulses with a duty factor of 13/16. In the case of the low drive power level, each drive pulse is a composite group of sub-pulses with a duty factor of 12/16. As shown, there is a changeover from the low drive power to the intermediate drive power status when the load torque on motor 18 rises above a value $y_1$ gm.cm. Similarly there is a changeover from intermediate drive status to high drive power status when the load torque increases above a value $Y_2$ gm.cm. A change from the high drive power to the intermediate drive power status occurs when the load goes below a value $X_2$, and a change from the intermediate to the low drive power status occurs when the load torque falls below a value $X_1$ gm.cm. This arrangement ensures that, whatever the level of load torque on stepping motor 18, a high power drive signal can never overlap an intermediate drive power or low drive power pulse in being applied to motor 18. The hysteresis characteristics shown in FIG. 16 may vary in practice, due to variations in the components of stepping motor 18, however these variations do not affect the characteristics to an extent which prevent the system being applied to mass production of electronic timepieces. Variations in the threshold voltages of inverters 70 and 74 of detection circuit 22 will also occur due to component variations, however in practice it has been found that if the threshold voltage is set to about 0.9 V, as shown in FIG. 15, no problems will arise which affect mass production utilization.

Although the preferred embodiment has been described with respect to a design having three different drive power levels, it is equally possible to utilize four or more drive power levels, with changeover between the levels in response to various load torque changes being performed as has been described for the preferred embodiment.

In addition, in the preferred embodiment, the drive coil 19 current flow is interrupted twice in succession following each drive pulse, when the system is operating in the intermediate drive power status. However it is equally possible to arrange that the second interruption of the current will be performed only if the threshold voltage of detection circuit 22 is not exceeded when the first interruption is performed. It is also possible to arrange that the drive coil current will be interrupted three or more times in succession after each intermediate level drive pulse, and to make the judgement as to whether to change to another power level on the basis of the induced voltages resulting from two of these interruptions.

It is also possible to modify the preferred embodiment such that a changeover from one drive power level to the next lower level is not performed starting from the next one-second period, but instead after several of these periods have elapsed.

Thus, although the present invention has been shown and described with respect to a particular embodiment, various changes and modification may be made to the above construction without departing from the spirit and scope of the present invention. It is intended that all matters contained in the above description or shown in the accompanying drawings shall be interpreted as illustrative, and not in a limiting sense. The appended claims are intended to cover all of the generic and specific features of the present invention.

What is claimed is:

1. In an electronic timepiece having a source of a standard frequency timebase signal, frequency divider means for producing a unit time signal and a plurality of timing signals by frequency division of said standard frequency timebase signal, drive circuit means responsive to said unit time signal for producing a drive signal, and a stepping motor having a drive coil and a rotor which is periodically rotated in response to said drive signals applied to said drive coil, the improvement comprising:

waveform converter circuit means coupled between said drive circuit and said frequency divider means and coupled to receive said unit time signal and said timing signals, for generating a plurality of drive input signals, each comprising a train of pulses synchronized with said unit time signal, for driving said stepping motor at a plurality of different drive power levels through said drive circuit means, said drive input signals including a minimum drive power level input signal and a maximum drive power level input signal, and at least one intermediate drive power level input signal, a selected one of said input signals being applied from said waveform converter circuit means to said drive circuit means, said drive circuit means being operable to establish a short-circuit condition across said drive coil in the intervals between periodic applications of said selected drive input signals to said drive circuit means, said waveform converter circuit means further producing at least one interruption signal pulse following each of said drive input signal pulses, said drive circuit means being responsive to said interruption signal pulse for interruption said short-circuit condition of said drive coil, with at least two of said interruption signal pulses occurring successively after each drive input signal pulse of level intermediate between said maximum drive power level input signal and said minimum drive power level input signal;

control and detection circuit means for detecting the amplitude of a voltage induced in said drive coil during each of said interruption signal pulses, said control and detection circuit means producing a first control signal if at least one of said drive coil induced voltages of said successive interruption signal pulses occurring after said intermediate drive input signal pulse is above a predetermined threshold level, and producing a second control signal if a remaining one of said drive coil induced voltages during said successive interruption signal pulses is above said predetermined threshold level;

said waveform converter circuit means being responsive to said first control signal for selecting a drive input signal of level lower than the drive input signal currently being applied, for application to said drive circuit means, and said waveform converter circuit means being further responsive to said second control signal for selecting a drive input signal of level higher than the drive input signal currently being applied, for application to said drive circuit means.

2. The improvement according to claim 1, in which at least one of said drive input signals comprises a train of composite pulse groups, each comprising a plurality of sub-pulses.

3. The improvement according to claim 2, in which an intermediate drive input signal and a drive input signal of level lower than said intermediate drive input signal are each composed of composite pulse groups, and wherein the sub-pulses of said lower level drive input signal have a lower duty cycle than said sub-pulses of said intermediate drive input signal.

4. The improvement according to claim 1, in which said drive circuit means comprises four metal oxide silicon field effect transistors with the gate electrode of each of said transistors being controlled independently of the remainder of said transistors.

5. The improvement according to claim 1, in which one end of said drive coil is connected to a reference potential during each interval in which said short-circuit condition of said drive coil is interrupted by said interruption pulse signal, said connection being established through a resistance of high value.

6. The improvement according to claim 1, in which said waveform converter circuit further produces a sampling signal pulse synchronized with each of said interruption signal pulses, said detection and control circuit means being responsive to said sampling signal pulse for detecting whether said drive coil induced voltage is above said predetermined threshold level.

7. The improvement according to claim 4, in which said interruption signal pulses are applied to gate electrodes of a first and a second transistor of said four metal oxide silicon field effect transistors, whereby a short-circuit condition across said drive coil established through said first and second transistors following each of said drive input signal pulses is interrupted during successive periods of said unit time signal by said interruption signal pulses controlling said first and second transistors during alternate periods of the unit time signal.

8. An electronic timepiece comprising:

a source of a standard frequency timebase signal;

a frequency divider circuit responsive to said standard frequency timebase signal for producing a unit time signal comprising a train of pulses having a period of one second, and for producing a plurality of timing pulses;

a first drive input signal generating circuit responsive to said unit time signal and said timing pulses for producing a train of pulses of predetermined duration synchronized with said unit time signal pulses, constituting a high drive input signal;

a second drive input signal generating circuit responsive to said unit time signal and said timing pulses for producing a first train of composite pulse groups each group being synchronized with one of said unit time signal pulses and composed of a plurality of sub-pulses;

a third drive input signal generating circuit responsive to said unit time signal and said timing pulses for producing a second train of composite pulse groups, each of said pulse groups being synchronized with one of said unit time signal pulses and composed of a plurality of sub-pulses of predetermined duty cycle, said second pulse train comprising a low drive input signal;

first gate circuit means for controlling the transfer of said first composite pulse train to an output thereof;

second gate circuit means for combining said low drive input signal pulses with said first composite pulse train from said first gate circuit means when said first gate circuit means is enabled, to thereby produce an intermediate drive input signal comprising a train of composite pulse groups, each of said pulse groups comprising a plurality of sub-pulses with the duty ratio thereof being higher than the duty ratio of said low drive input signal sub-pulses;

a first selector circuit coupled to receive the output from said second gate circuit means and said high drive input signal;

a stepping motor having a drive coil;

a drive circuit comprising a first and a second field effect transistor connected in series between a high and a low potential of a power source, with the drain electrodes of said first and second transistors being connected together and to one end of said drive coil, and further comprising a third and a fourth field effect transistor connected in series between said high and low potentials, with the drain electrodes thereof connected in common to another end of said drive coil, said first and third transistors having the gate terminals thereof coupled to outputs of said first selector circuit;

a sampling signal generating circuit coupled to receive said unit time signal and timing pulses from said frequency divider circuit, for producing a single sampling pulse after a first predetermined delay after each drive input pulse, when said high drive input signal is selected by said first selector circuit, for producing a single sampling pulse after a second predetermined delay after each drive input pulse, when said low drive input signal is selected by said first selector circuit, and for producing two consecutive sampling pulses after a third predetermined delay following each drive input pulse, when said intermediate drive input signal is produced by said second gate circuit means and is selected by said first selector circuit;

an interruption signal generating circuit responsive to said unit time signal and said timing pulses from said frequency divider circuit for producing a single interruption pulse after said first predetermined delay following a drive input pulse when said high drive input signal is selected by said first selector circuit, for producing a single interruption pulse after said second predetermined delay following a drive input pulse, when said low drive input signal is selected by said first selector circuit, and for producing a pair of consecutive interruption pulses after a third predetermined delay following each drive input pulse, when said intermediate drive input signal is produced by said second gate circuit means and is selected by said first selector circuit;

third gate circuit means for combining said interruption pulses with said drive input signals output from said first selector circuit, outputs of said third gate means being coupled to gate electrodes of said second and fourth transistors of said drive circuit;

a detection circuit coupled to each end of said drive coil, being responsive to an induced voltage in said drive coil having an amplitude higher than a predetermined level for producing an output signal;

a second selector circuit coupled to receive said sampling pulses, and responsive to an output signal from said detection circuit coincident with one of said sampling pulses for producing an output pulse;

a status set signal generating circuit responsive to said unit time signal and said timing pulses from said frequency divider circuit for producing a first set pulse at the start of each of said drive input pulses selected by said first selector circuit, a second set pulse after a fourth predetermined delay following said selected drive input pulse, and a third set pulse after a fifth predetermined delay following said selected drive input pulse;

a status reset signal generating circuit responsive to said unit time signal and said timing pulses from said frequency divider circuit for producing a first reset signal comprising two consecutive pulses following each of said selected drive input pulses, with the first of said two consecutive pulses being coincident with the first of said two consecutive sampling pulses and the second being coincident with said second sampling pulse generated after said second predetermined delay, said reset signal generating circuit further producing a second reset signal comprising a pulse produced after said selected drive input pulse following a sixth predetermined delay;

fourth gate circuit means coupled to receive said first reset signal and the output of said second selector circuit;

a first flip-flop circuit having a set terminal coupled to receive said second set signal and a reset terminal coupled to receive the output from said fourth gate circuit means;

a second flip-flop circuit having a set terminal coupled to receive said first set signal and a reset terminal coupled to the output of said second selector circuit;

fifth gate circuit means coupled to receive said second reset signal and an output signal from said second flip-flop circuit; and a third flip-flop circuit having a set terminal coupled to receive said third set signal and a reset terminal coupled to receive the output from said fifth gate circuit means;

a first control signal produced when said first flip-flop circuit attains a set state being applied to said first gate circuit means for thereby enabling an output signal from said second drive input signal generating circuit to be input to said second gate circuit means, to be combined with said low drive input signal and a second control signal produced by said third flip-flop circuit being applied to said first selector circuit for selecting said high drive input signal to be output from said first selector circuit.

* * * * *